US005520072A

United States Patent [19]

Perry

[11] Patent Number: 5,520,072

[45] Date of Patent: May 28, 1996

[54] BREAK DOWN TONG APPARATUS

[76] Inventor: Robert G. Perry, 5335 E. Terrace Ave., Indianapolis, Ind. 46203

[21] Appl. No.: 395,053

[22] Filed: Feb. 27, 1995

[51] Int. Cl.[6] ..... B25B 13/50

[52] U.S. Cl. ..... 81/57.16; 81/57.18; 81/57.34

[58] Field of Search ..... 81/57.14–57.21, 81/57.3, 57.33, 57.34, 57.35

[56] References Cited

U.S. PATENT DOCUMENTS

| | | | |
|---|---|---|---|
| 2,150,611 | 3/1939 | Speck . | |
| 2,405,757 | 8/1946 | Rowland . | |
| 2,509,853 | 5/1950 | Wilson . | |
| 2,552,521 | 5/1951 | Coshow . | |
| 2,668,689 | 2/1954 | Cormany . | |
| 2,862,690 | 12/1958 | Mason . | |
| 2,952,177 | 9/1960 | Skillin . | |
| 2,979,320 | 4/1961 | Adams . | |
| 3,012,457 | 12/1961 | Powell et al. . | |
| 3,203,737 | 8/1965 | Robbins et al. . | |
| 3,227,419 | 1/1966 | Lackey . | |
| 3,521,509 | 7/1970 | Duke et al. . | |
| 3,550,485 | 12/1970 | Dickmann . | |
| 3,726,506 | 4/1973 | Vanderwaal et al. . | |
| 3,799,009 | 3/1974 | Guier . | |
| 3,799,010 | 3/1974 | Guier . | |
| 3,807,695 | 4/1974 | Gremillion et al. . | |
| 3,832,918 | 9/1974 | Lang et al. . | |
| 3,834,668 | 9/1974 | Casey . | |
| 3,907,253 | 9/1975 | Schosek . | |
| 3,951,216 | 4/1976 | Crawshay et al. . | |
| 3,957,113 | 5/1976 | Jones et al. . | |
| 4,000,879 | 1/1977 | Martin et al. . | |
| 4,092,881 | 6/1978 | Jürgens et al. . | |
| 4,095,493 | 6/1978 | Haynes . | |
| 4,170,907 | 10/1979 | Cathcart . | |
| 4,246,809 | 1/1981 | Keast et al. . | |
| 4,333,365 | 6/1982 | Perry . | |
| 4,368,873 | 1/1983 | Perry . | |
| 4,372,026 | 2/1983 | Mosing | 81/57.14 X |
| 4,437,218 | 3/1984 | Pridy | 81/57.35 X |
| 4,821,814 | 4/1989 | Willis et al. . | |
| 4,936,708 | 6/1990 | Perry . | |
| 5,015,124 | 5/1991 | Perry . | |
| 5,231,899 | 8/1993 | Lee | 81/57.16 |
| 5,271,298 | 12/1993 | Gazel-Anthoine | 81/57.16 |

FOREIGN PATENT DOCUMENTS 694604 10/1979 U.S.S.R. .

*Primary Examiner*—D. S. Meislin
*Attorney, Agent, or Firm*—Barnes & Thornburg

[57] ABSTRACT

A tong apparatus is provided for gripping a pipe. The apparatus includes a base, and a support rigidly coupled to the base. The support is formed to include an aperture for receiving the pipe. The apparatus also includes a plurality of rollers rotatably coupled to the support adjacent the aperture. Each roller includes a plurality of teeth configured to engage the pipe. The apparatus further includes a movable actuator coupled to the support, and a plurality of wedge plates rigidly coupled to the actuator. Each wedge plate includes a plurality of teeth configured to engage the teeth of a corresponding roller to force the rollers radially inwardly against the pipe to grip the pipe upon movement of the actuator relative to the support. The apparatus still further includes a cylinder having a piston coupled to the actuator. The piston is movable from an extended position to a retracted position to move the actuator relative to the support.

25 Claims, 7 Drawing Sheets

BREAK DOWN TONG APPARATUS

BACKGROUND AND SUMMARY OF THE INVENTION

The present invention relates to an improved break down tong apparatus. More particularly, the present invention relates to a power tong apparatus and a cooperating backup tong apparatus for breaking connections between links of pipe as the pipe is being removed from the ground.

It is well known to push a rod or pipe through the ground with a drilling rig from one location to another predetermined location beneath the surface of the ground. For example, a pipe may be pushed under a road from one side of the road to another without creating a trench in the road. Generally speaking, apparatus for directing forward movement of a pipe through the ground beneath the surface of the ground are known in the art. Drilling rigs are also used to drill into the ground for oil wells or the like. Typically, these drilling rigs rotate the pipe in a counterclockwise direction or a clockwise direction to install or remove pipe from the ground.

Making and breaking apparatus are known for making up or breaking out joints between adjacent pipes which are driven into the ground with known drilling rigs. As the pipe is being removed from the ground, joints between adjacent sections must be loosened to permit the next section of pipe to be removed from the ground.

The power tong apparatus of the present invention includes two separate tongs operating in conjunction with each other. A backup tong is provided to grip and hold a lower section of pipe which extends into the ground stationary. A power tong is provided to grip and rotate an upper section of pipe which is connected to the lower section of pipe in the ground. While the backup tong prevents rotation of the lower length of pipe, the power tong grips and rotates the upper section of pipe to break the joint between the upper and lower pipe sections.

According to one aspect of the present invention, a tong apparatus is provided for gripping a pipe. The apparatus includes a base, and a support rigidly coupled to the base. The support is formed to include an aperture for receiving the pipe. The apparatus also includes a plurality of rollers rotatably coupled to the support adjacent the aperture. Each roller includes a plurality of teeth configured to engage the pipe. The apparatus further includes a movable actuator coupled to the support, and a plurality of wedge plates rigidly coupled to the actuator. Each wedge plate includes a plurality of teeth configured to engage the teeth of a corresponding roller to force the rollers radially inwardly against the pipe to grip the pipe upon movement of the actuator relative to the support. The apparatus still further includes a cylinder having a piston coupled to the actuator. The piston is movable from an extended position to a retracted position to move the actuator relative to the support.

In the illustrated embodiment, the apparatus includes an elastic band coupled to the plurality of rollers and to the support to apply a radially outwardly directed force to the rollers to hold the rollers away from the pipe when the wedge plates are disengaged from the rollers. The plurality of wedge plates and the plurality of rollers are preferably made from a heat treated metal material.

Also in the illustrated embodiment, the support includes a first support plate coupled to the base, and a second support plate rigidly coupled to the base spaced apart from the first support plate. The teeth of the plurality of rollers are located between the first and second support plates. The first and second support plates each include a plurality of elongated slots for receiving opposite ends of the plurality of elongated rollers therein.

The actuator includes an annular body surrounding the plurality of rollers. The annular body is rotatably coupled between the first and second support plates. The wedge plates are configured to engage the rollers upon rotation of the actuator relative to the first and second support plates in either direction.

In another illustrated embodiment, the support includes a fixed support rigidly coupled to the base and a rotatable support coupled to the fixed support. The plurality of rollers are coupled to the rotatable support so that the rollers grip and rotate the pipe relative to the fixed support upon movement of the actuator. At least one spring is coupled between the actuator and the rotatable support to prevent rotation of the rotatable support until the teeth of the rollers engage the pipe upon movement of the actuator by the piston. The rotatable support rotates relative to the fixed support after the rollers grip the pipe to rotate the pipe upon further movement of the actuator by the piston.

In the illustrated embodiment, an arm is coupled to the rotatable support. The arm is also coupled to one end of the spring. A first stop is coupled to the fixed support to engage the arm and block movement of the rotatable support in a first direction to permit disengagement of the wedge plates from the rollers to release the pipe. A second is stop coupled to the fixed support to engage the arm and block movement of the rotatable support in a second direction to permit a main drive to break itself loose from the pipe.

According to another aspect of the present invention, a break down tong apparatus is provided for breaking loose a joint connection between a first pipe and an adjacent second pipe. The apparatus includes a base and a backup tong having a first support rigidly coupled to the base. The first support is formed to include a first aperture for receiving the first pipe. The backup tong also includes a first set of rollers rotatably coupled to the first support. Each first roller includes a plurality of teeth configured to engage the first pipe. The backup tong further includes a movable first actuator coupled to the first support. A first set of wedge plates are rigidly coupled to the first actuator. Each wedge plate includes a plurality of teeth configured to engage the teeth of a corresponding first roller to force the first rollers radially inwardly against the first pipe to grip the first pipe upon movement of the first actuator relative to the first support. The backup tong still further includes a first cylinder having a first piston coupled to the actuator. The first piston is movable from an extended position to a retracted position to move the first actuator relative to the first support. The break down tong apparatus also includes a power tong having a fixed support rigidly coupled to the base and a rotatable support coupled to the fixed support. The rotatable support is formed to include a second aperture for receiving the second pipe. A second set of rollers is rotatably coupled to the rotatable support adjacent the second aperture. Each second roller includes a plurality of teeth configured to engage the second pipe. The power tong also includes a movable second actuator coupled to the fixed support, and a second set of wedge plates rigidly coupled to the second actuator. Each second wedge plate includes a plurality of teeth configured to engage the teeth of a corresponding second roller to force the second rollers radially inwardly against the second pipe to grip the second pipe upon movement of the second actuator relative to the fixed support. The power tong apparatus still further includes a second cylinder having a second piston coupled to the actuator. The second piston is movable from an extended position to a retracted position to move the actuator relative to the fixed support to rotate the second pipe relative to the first pipe to break the joint connection between the first pipe and the second pipe.

In the illustrated embodiment, the apparatus further includes a bearing surrounding the first pipe. The bearing is located adjacent the backup tong on an opposite side of the backup tong from the power tong.

At least one spring is coupled between the second actuator and the rotatable support to prevent rotation of the rotatable support until the teeth of the second rollers engage the second pipe upon movement of the second actuator by the second piston. The rotatable support rotates relative to the fixed support after the second rollers grip the second pipe to rotate the second pipe upon further movement of the second actuator by the second piston.

The apparatus still further includes a sequence control valve for actuating, in sequence, the first cylinder to move the first piston to cause the first set of rollers to engage the first pipe, then actuating the second cylinder to move the second piston to cause the second set of rollers to engage the second pipe. The sequence control valve further moves the second piston to cause rotation of the rotatable support relative to the fixed support to break the joint connection between the first pipe and the second pipe. The sequence control valve then actuates the second cylinder to move the second piston to release the second set of rollers from the second pipe before the first cylinder is actuated to release the first set of rollers from the first pipe to permit a main drive coupled to the second pipe to rotate the second pipe to uncouple the first pipe from the second pipe. The sequence control valve next actuates the second cylinder to move the second piston to its extended position after the first and second joint portions are uncoupled to permit the main drive coupled to the second pipe to break itself loose from the end of the second pipe.

The apparatus includes an arm coupled to the rotatable support. The arm is coupled to one end of the spring. A first stop is coupled to the fixed support to engage the arm block movement of the rotatable support in a first direction to permit disengagement of the wedge plates from the rollers to release the pipe. A second stop is coupled to the fixed support to engage the arm and block movement of the rotatable support in a second direction to permit a main drive to break itself loose from the pipe.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
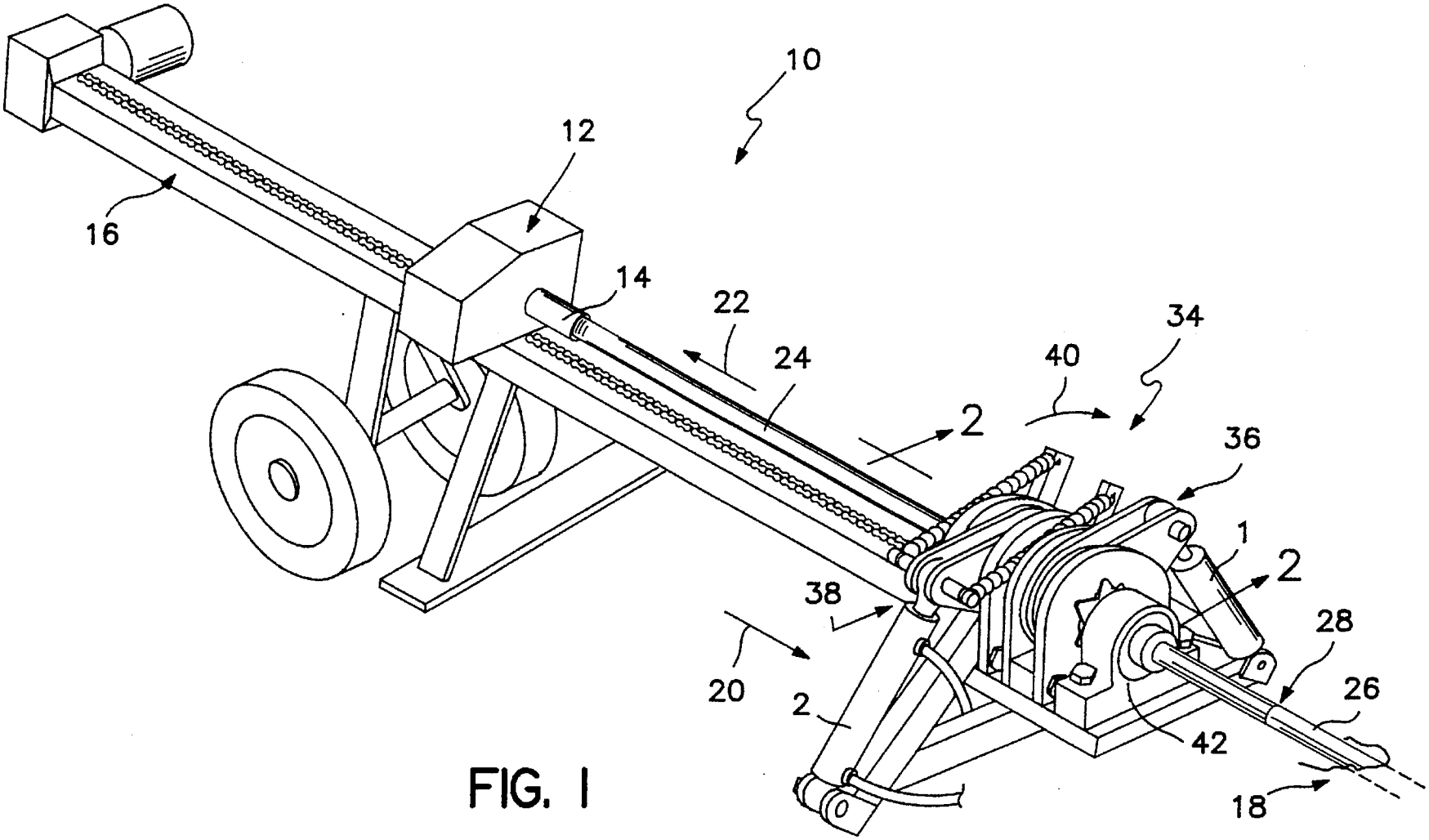
FIG. 1 is a perspective view illustrating a drilling rig having a main drive mechanism for inserting and removing sections of pipe into the ground with a break down tong apparatus of the present invention mounted on the drilling rig.
Figure 2:
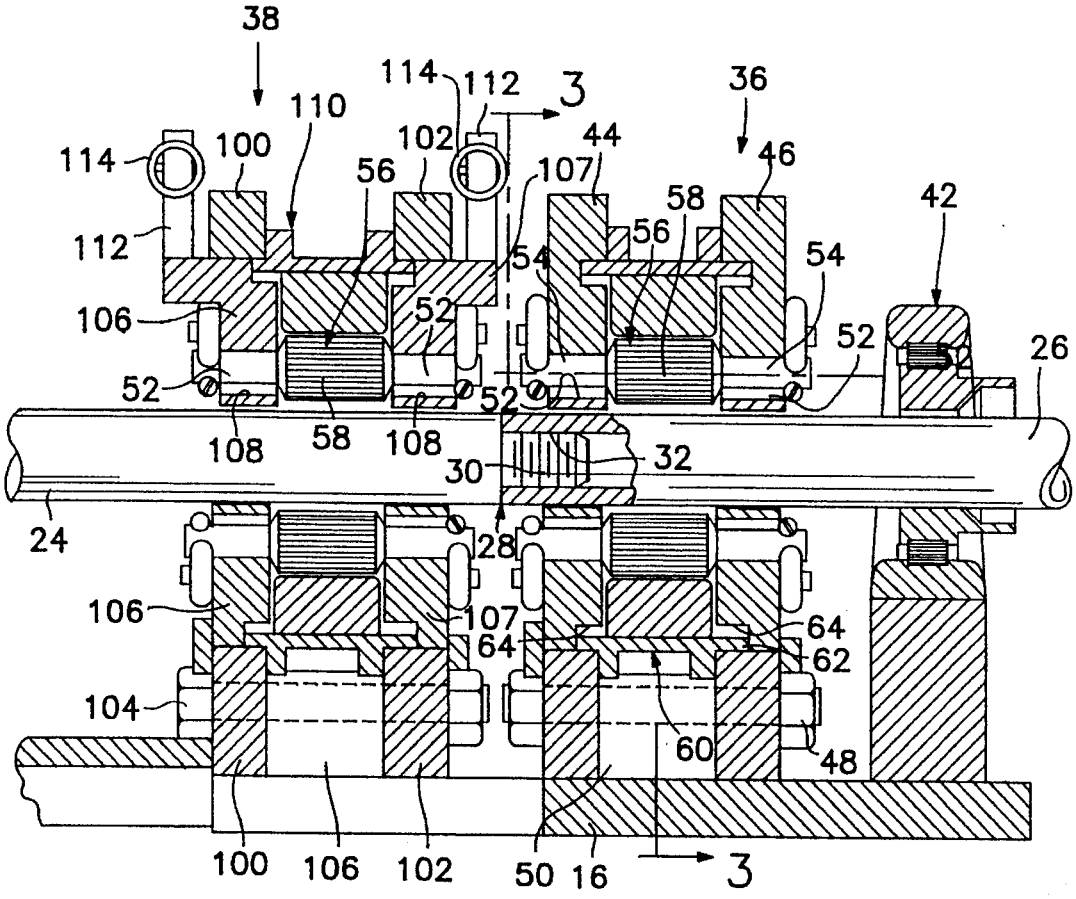
FIG. 2 is a sectional view taken through the break down tong apparatus of the present invention along lines 2—2 of FIG. 1 illustrating the configuration of a power tong apparatus, a backup tong apparatus, and a bearing mounted adjacent the backup tong apparatus, and with a pipe joint coupling a first upper pipe section to a second lower pipe section located between the power tong apparatus and the backup tong apparatus.

Referring now to the drawings, FIG. 1 illustrates drilling rig 10 including a main drive 12 having a threaded drive head 14. Main drive unit 12 is driven back and forth over frame 16. Main drive unit 12 rotates threaded drive head 14 to drive pipe sections 24 and 26 into the ground 18. After lower pipe 26 is driven into the ground 18, pipe 24 must be connected to a threaded end of lower pipe 26 in order to continue driving the pipe into the ground. Main drive 12 rotates drive head 14 and pushes the pipe in the direction of arrow 20 to move the pipe into the ground 18. Pipe is also removed from the ground 18 using main drive 12 which rotates and pulls the pipe in the direction of arrow 22. In FIG. 1, an upper pipe section 24 is connected to threaded drive 14 and a lower pipe section 26 is coupled to upper pipe 24 by a joint 28 as best illustrated in FIG. 2. Joint 28 includes a male joint portion 30 coupled to upper pipe 24 and a female joint portion 32 coupled to lower pipe 26. In order to remove the upper pipe 24 from lower pipe 26, the joint 28 between upper pipe 24 and lower pipe 26 must be broken. Although a portable drilling rig 10 is illustrated, it is understood that any type of drilling rig can be used in accordance with the present invention. Drilling rig 10 can be positioned in a horizontal position as illustrated in FIG. 1 or in a vertical position for drilling straight down into the ground.

Figure 9:
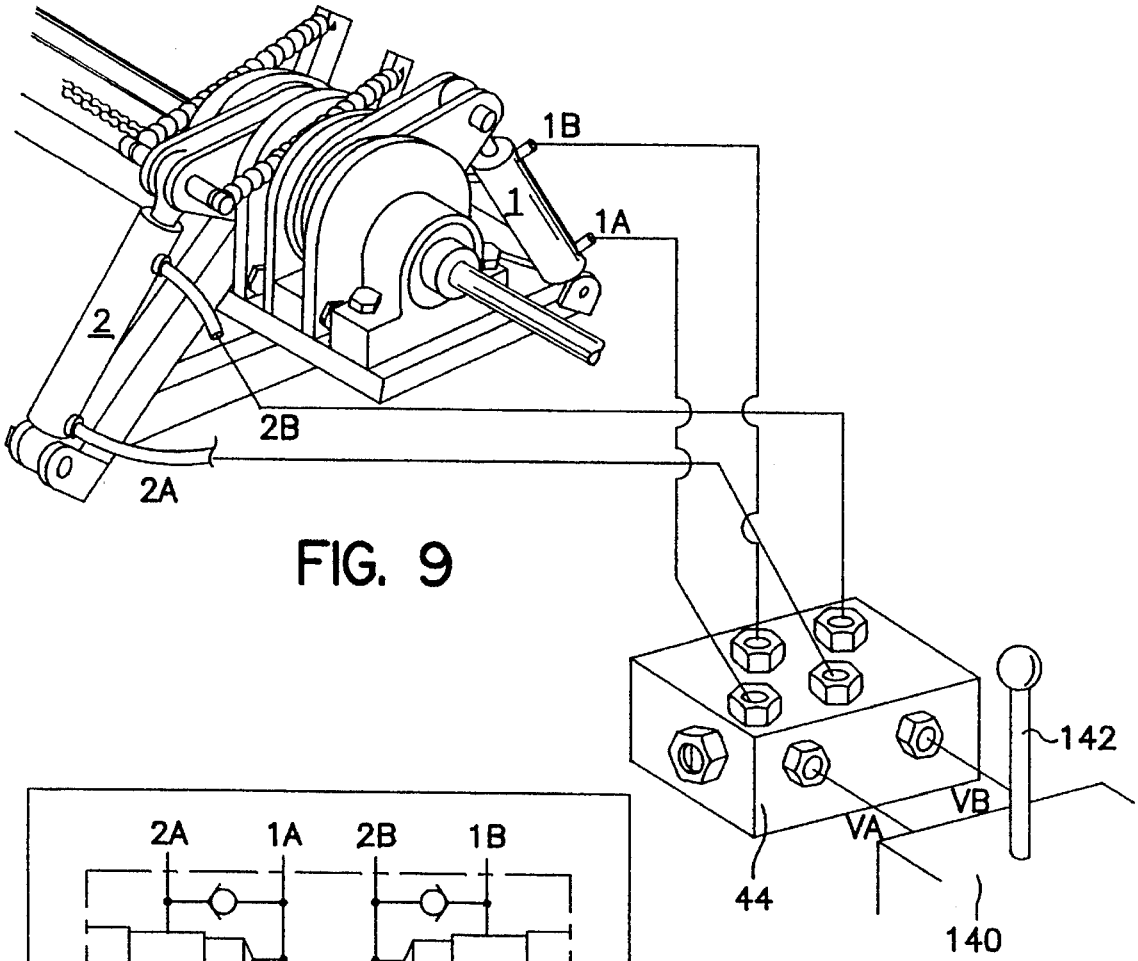
FIG. 9 is a diagrammatical view illustrating a dual sequence control valve for coupling a hydraulic pressure source to the first and second cylinders to actuate the first and second pistons, respectively, and control the break down tong apparatus.
Figure 11:
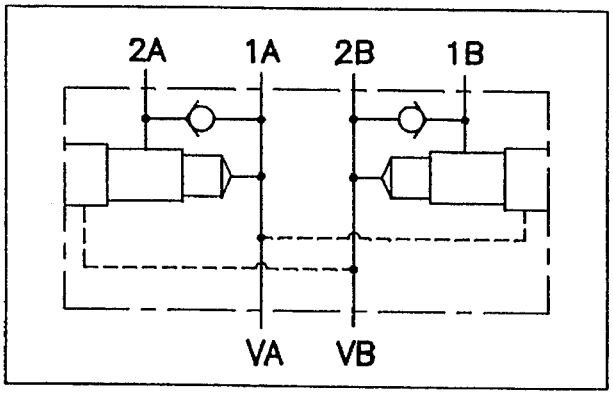
FIG. 11 is a fluid flow diagram of a preferred embodiment of the present invention.
Figure 10:
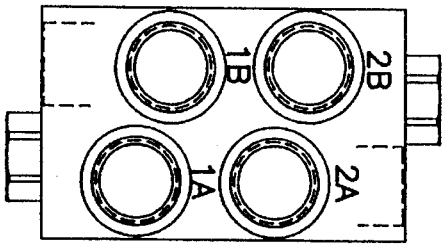
FIG. 10 is a top plan view of the sequence control valve of FIG. 9.
Figure 12:
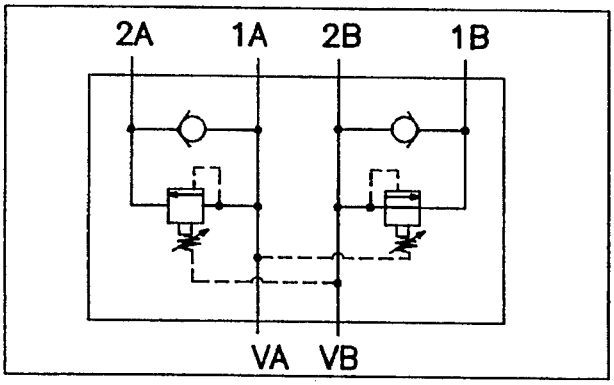
FIG. 12 is a pressure control diagram of the preferred embodiment of the present invention.

Referring again to FIG. 1, a break down tong apparatus 34 is provided to break the connection between joint portions 30 and 32. Break down tong apparatus 34 includes a backup tong apparatus 36 which grips lower pipe 26 and holds lower pipe 26 stationary. Break down tong apparatus 34 also includes a power tong apparatus 38 which grips and rotates upper pipe 24 in the direction of arrow 40 to break the connection between upper and lower joint sections 30 and 32 of joint 28. Break down tong apparatus 34 also includes a bearing 42 coupled to frame 16 adjacent backup tong apparatus 36. Bearing 42 surrounds lower pipe 26 to help align and stabilize the pipe as the pipe is driven into the ground 18 to reduce wear and tear on the backup tong apparatus 36 and power tong apparatus 38 as the pipe is driven into the ground 18. A sequence control valve 44 illustrated in FIG. 9 is provided to control actuation of cylinders 1 and 2 to control break down tong apparatus 34 as discussed in detail below.

Figure 5:
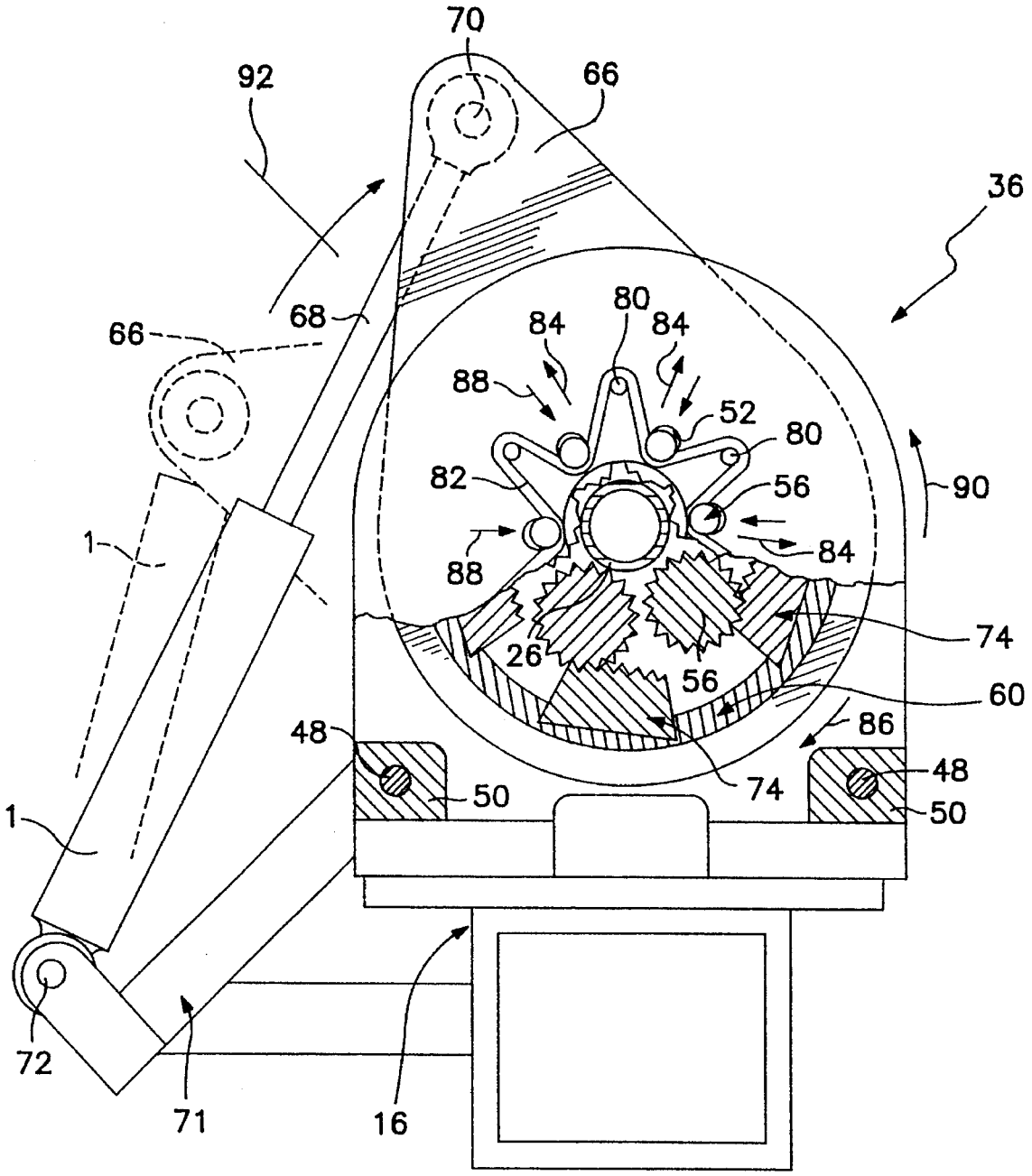
FIG. 5 is a sectional view with portions broken away further illustrating the configuration of the backup tong apparatus.

Backup tong apparatus is best illustrated in FIGS. 2 and 5. Backup tong apparatus 36 includes a fixed support formed by spaced apart support plates 44 and 46. Support plates 44 and 46 are rigidly coupled to frame 16 by fasteners 48 which extend through mounting blocks 50 that are preferably welded to frame 16. Support plates 44 and 46 are formed to include a plurality of elongated slots 52 for receiving opposite smooth ends 54 of rollers 56 therein. Rollers 56 include a plurality of teeth 58 located between support plates 44 and 46. In the illustrated embodiment, six rollers 56 are provided spaced around an aperture for receiving the pipe. It is understood, however, that any number of such rollers 56 may be provided in accordance with the present invention.

Backup tong apparatus 36 includes an internal, rotatable actuator 60. Rotatable actuator 60 includes a flange 62 configured to engage in arcuate groove 64 formed in both support plates 44 and 46. As best illustrated in FIG. 5, rotatable actuator 60 includes an extension section 66 which is rotatably coupled to a piston 68 by coupling 70. Piston 68 moves back and forth within backup cylinder 1. An opposite end of backup cylinder is pivotably coupled to a support 71 at location 72. Support 71 is rigidly coupled to frame 16. Piston 68 is movable from an extended position illustrated in solid lines in FIG. 5 to a retracted position illustrated by the dotted lines in FIG. 5. Such movement of piston 68 causes rotation of actuator 60 relative to outer fixed support plates 44 and 46.

Figure 3:
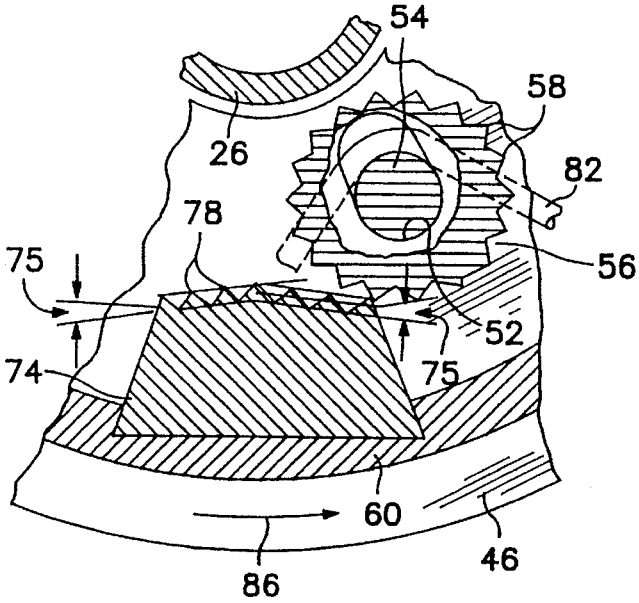
FIG. 3 is a sectional view taken along lines 3—3 of FIG. 2 illustrating the configuration of one of the toothed rollers of the backup tong apparatus and a wedge plate having a plurality of teeth which are synchronized and configured to mesh with the teeth of the roller.
Figure 4:
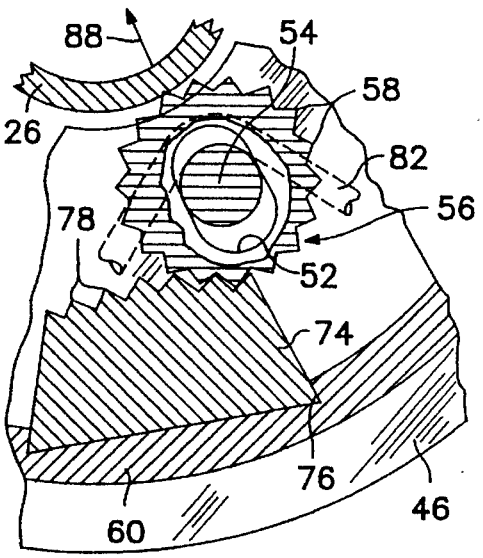
FIG. 4 is a sectional view similar to FIG. 3 illustrating the toothed roller and the wedge plate of the backup tong apparatus after the teeth of the roller have engaged the teeth of the wedge plate to move the roller radially inwardly into engagement with the lower pipe section.

A plurality of ramp or wedge plates 74 are rigidly coupled to actuator 60. As best illustrated in FIGS. 3 and 4, wedge plates 74 are preferably press fit into a notched tracks 76 formed in actuator 60. Wedge plates 74 are formed to include a plurality of teeth 78 which are synchronized with the teeth 58 of rollers 56. In other words, teeth 78 are configured to mesh with teeth 58 formed on rollers 56 to act like a plurality of gears.

As illustrated best in FIG. 5, fixed support plates 44 and 46 are each formed to include a plurality of posts 80 located between rollers 56. A rubber or elastic band 82 wraps around the posts and the rollers to apply a radially outwardly directed force against rollers 56 in the direction of arrows 84. It is understood that band 82 can be made of any type of elastic material. Band 82 holds teeth 58 of rollers 56 out of engagement with pipe 26.

When it is desired for the backup tong apparatus 36 to engage and grip pipe 26, backup cylinder 1 is controlled to move piston 68 from a retracted position to its extended position illustrated in FIG. 5. This movement of piston 68 causes rotation of actuator 60 and the plurality of wedge plates 74 relative to support plates 44 and 46 and rotatable rollers 56. As illustrated in FIG. 3, as actuator 60 is rotated in the direction of arrow 86, teeth 78 of wedge plate 74 move into engagement with the teeth 58 of rollers 56. As the teeth 58 of rollers 56 mesh like gear teeth with teeth 78 of wedge plates 74, wedge plates 74 force rollers 56 radially inwardly in the direction of arrows 88 of FIGS. 4 and 5. Such radially inward movement of rollers 56 causes engagement between the teeth 58 of rollers 56 and pipe 26. This is illustrated in FIGS. 4 and 5. Therefore, engagement of the plurality of wedge plates 74 with the plurality of rollers 56 causes the plurality of rollers 56 to move radially inwardly in the direction of arrows 88 to engage and grip pipe 26 and prevent rotation of pipe 26 relative to support plates 44 and 46.

A top surface of each wedge plate is aligned at about a 7° ramp angle in each direction as illustrated by angles 75 in FIG. 3. Wedge plates 74 and rollers 56 are all formed from a very hard heat treated metal material.

Backup tong apparatus 36 can also grip pipe section 26 when piston 68 is moved to its retracted position illustrated by dotted lines in FIG. 5. In this instance, actuator 60 and wedge plates 74 rotate in the direction of arrow 90 in FIG. 5 to engage a respective roller 56 located to the right of each wedge plate 74 as illustrated in FIG. 5. Therefore, when piston 68 is extended to the midpoint as illustrated at location 92 in FIG. 5, wedge plates 74 are disengaged from rollers 56 as illustrated in FIG. 3 so that rollers 56 are forced radially outwardly by band 82 in the direction of arrows 84 to move away from pipe section 26 and permit free movement of pipe section 26 relative to support plates 44 and 46. A marking can be positioned on backup cylinder 1 to indicate the unengaged position, if desired.

Power tong apparatus 38 operates in a manner similar to backup tong apparatus 36. Power tong apparatus 38 includes a pair of outer fixed support plates 100 and 102 which are rigidly coupled to frame 16 by suitable fasteners 104 which extend through mounting blocks 106. Power tong apparatus 38 includes an inner rotatable support including support plates 106 and 107 which are rotatably coupled to outer fixed support plates 100 and 102, respectively. The rotatable inner supports 106 and 107 are formed to include elongated slots 108 for receiving opposite ends 52 of rollers 56. Teeth 58 of rollers 58 are located between rotatable support plates 106 and 107. A rotatable actuator 110 similar to actuator 60 of backup tong apparatus 36 is also rotatably coupled to fixed support plates 100 and 102. A plurality of wedge plates 74 are rigidly coupled to actuator 110 in a manner similar to backup tong apparatus 36. A pair of extension arms 112 are coupled to outer rotatable support plates 106 and 107. Springs 114 are coupled to extension arms 112 and to a pivot post 116 extending between extension sections 118 of actuator 110. Piston 120 of power tong cylinder 2 is also rotatably coupled to pivot pin 116. An opposite end of power tong cylinder 2 is rotatably coupled to a support 122 at location 124. Support 122 is rigidly coupled to frame 16.

Figure 6:
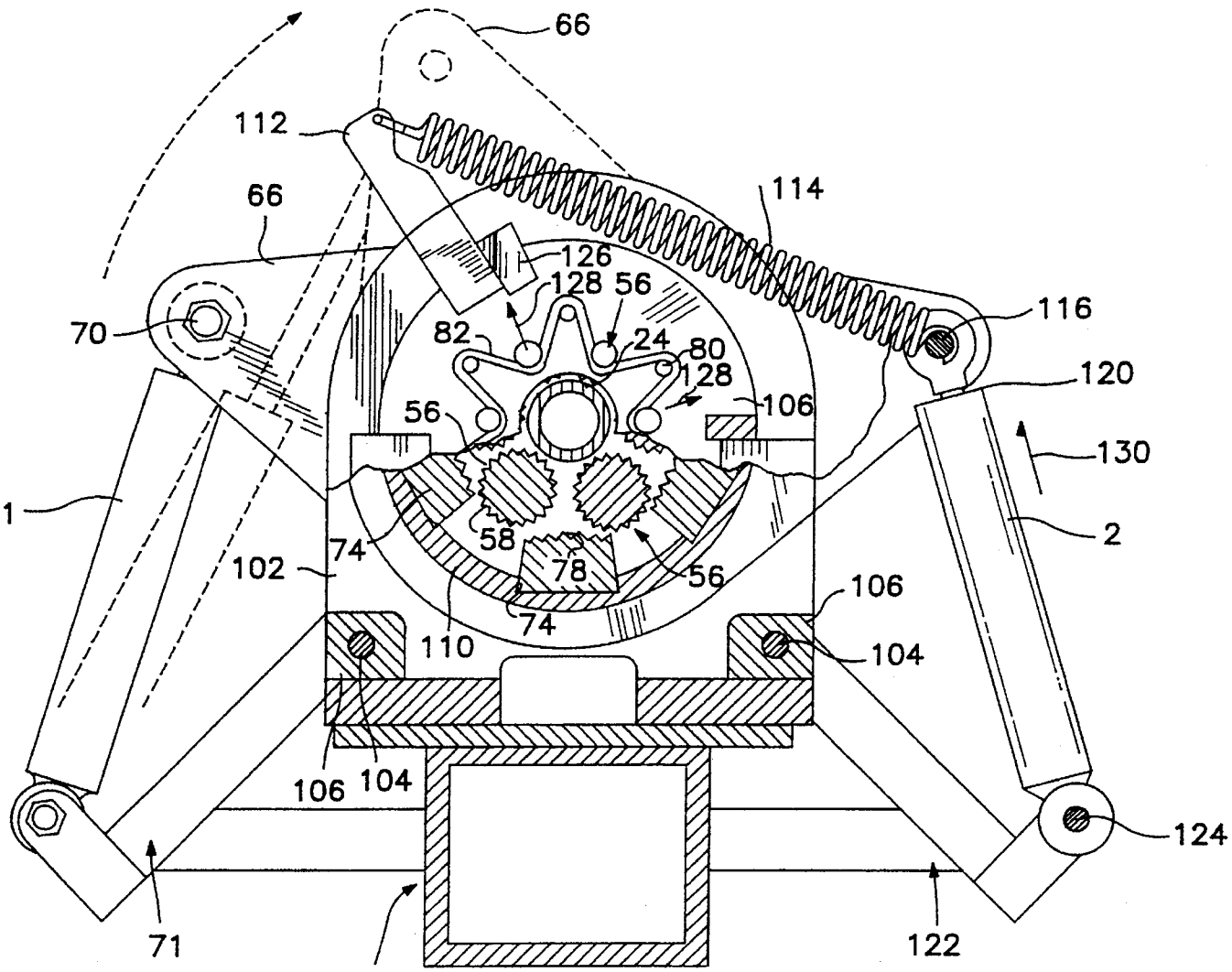
FIG. 6 is a sectional view with portions broken away further illustrating the configuration and operation of the power tong apparatus before the rollers have been moved to engage the upper pipe by the wedge plates of the power tong apparatus.
Figure 7:
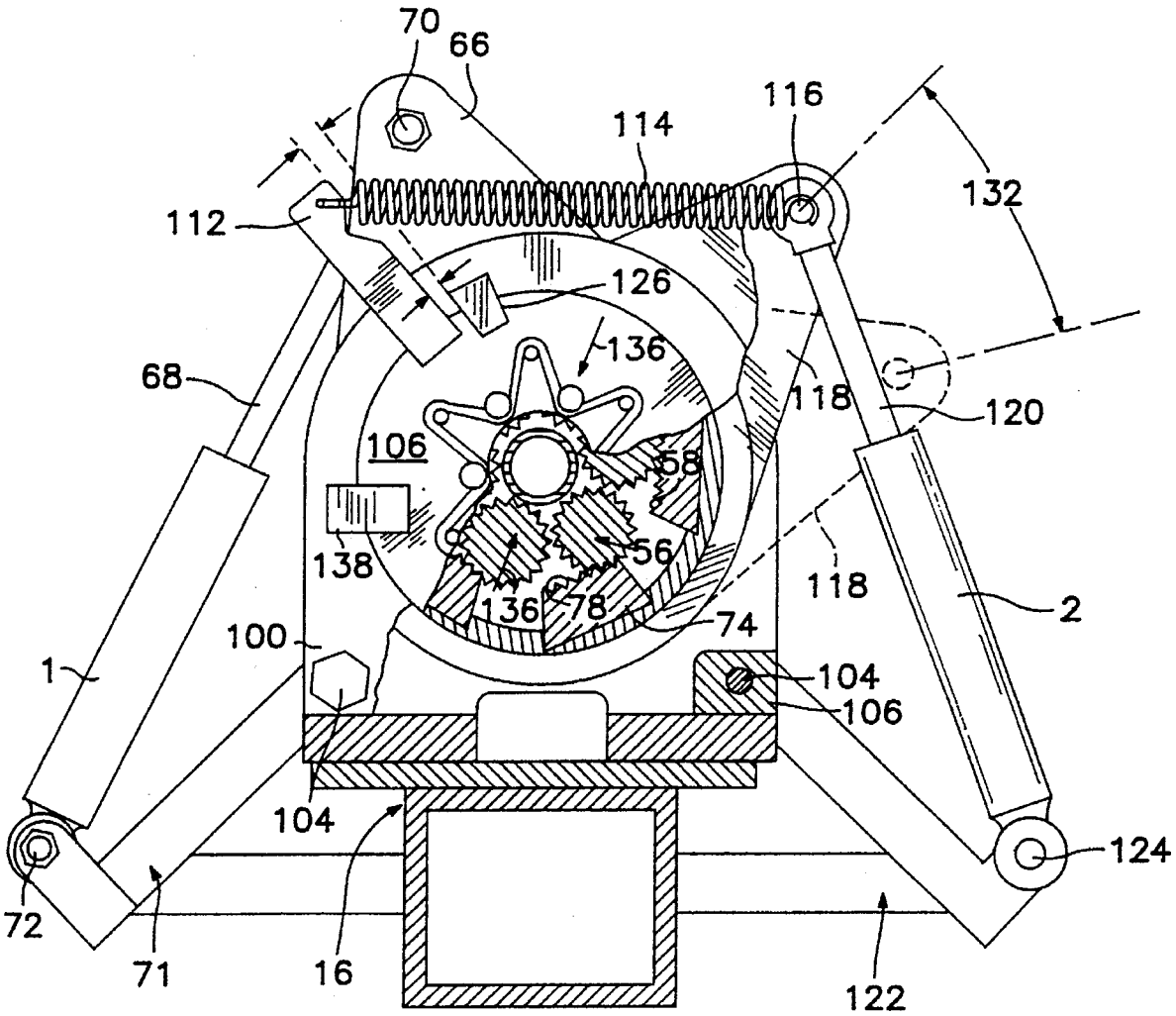
FIG. 7 is a sectional view similar to FIG. 6 illustrating engagement of the rollers of the power tong apparatus with the upper section of the pipe.

When piston 120 of power tong cylinder 2 is in its retracted position illustrated in FIG. 6, the rollers 56 of the power tong apparatus 36 are disengaged from pipe 24. Arms 112 engage a first fixed stop 126 coupled to fixed support plates 100 and 102. In the position of FIG. 6, band 82 operates to force rollers 56 radially outwardly in the direction of arrow 128 away from pipe 24. After backup tong apparatus 36 has been actuated to grip pipe section 26, power tong cylinder 2 is then actuated to extend piston 120 in the direction of arrow 130 of FIG. 6. As illustrated in FIG. 7, springs 114 coupled to arms 112 hold outer rotatable support plates 106 and 107 and prevent rotation of support plates 106 and 107 and the rollers 56 relative to fixed support plates 100 and 102 as the actuator 110 moves relative to outer plates 100 and 102. This is illustrated in FIG. 7. As piston 120 is extended to move extension arm 118 from the dotted position to the solid position of FIG. 7, pivot pin 116 moves through an angle illustrated by dimension 132.

Springs 114 coupled to arms 112 prevent rotation of rotatable support plates 106 and 107 until wedge plates 74 move into engagement with rollers 56. Therefore, actuator 110 rotates in the direction of arrow 134 relative to both the outer fixed support plates 100 and 102 and the rotatable support plates 106 and 107 until wedge plates 74 engage rollers 56. After the teeth 78 of wedge plates 74 engage teeth 58 of rollers 56, rollers 56 move radially inwardly in the direction of arrows 136 in FIG. 7. Teeth 58 of rollers 56 engage pipe section 24. Further extension of piston 120 by power tong cylinder 2 causes rotation of both the actuator 110 and outer rotatable support plates 106 and 107 relative to outer fixed plates 100 and 102 in the direction of arrow 134 in FIG. 8. Such rotation also causes upper pipe section 24 to be rotated in the direction of arrow 134 to break the threaded joint connection between male joint portion 30 and female joint portion 32 of lower pipe section 26 which is held stationary by backup tong apparatus 36.

Figure 8:
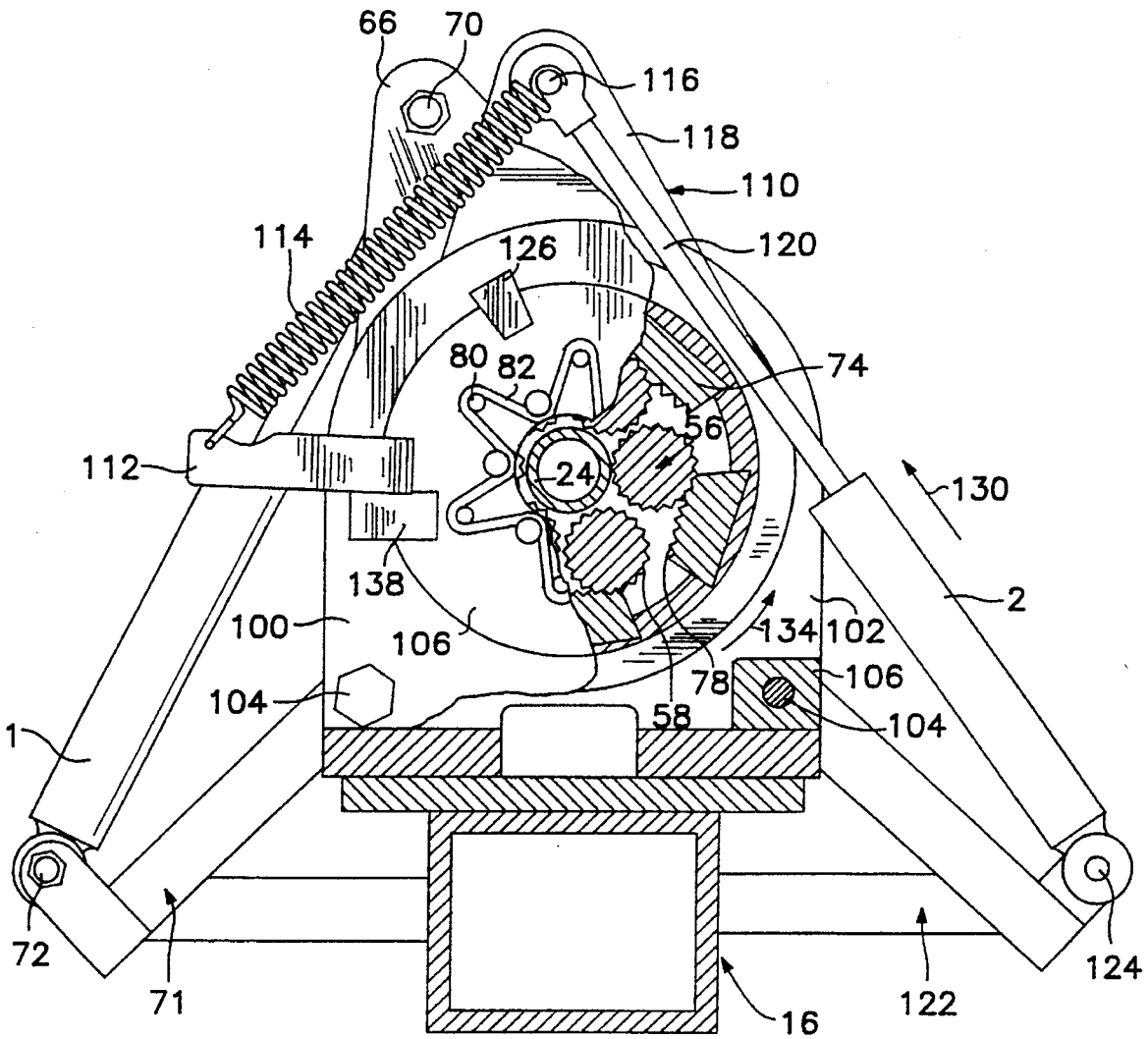
FIG. 8 is a sectional view similar to FIGS. 6 and 7 illustrating further movement of the actuator and rotatable support of the power tong apparatus to rotate the upper pipe section break the joint connection between the upper and lower pipe sections.

FIG. 8 illustrates that a second pair of stops 138 are rigidly coupled to fixed outer plates 100 and 102. Cylinder 2 of power tong apparatus 2 rotates upper section 24 of pipe about twenty degrees to break the joint connection 28. After extension arms 112 engage stops 138, piston 120 continues to apply force in the direction of arrow 130. When arms 112 are engaged with stops 138, the rollers 56 will not slip. This permits main drive 12 to be actuated to break its own connection from and end of upper pipe 24 to permit upper pipe 24 to be removed from drilling rig 10. The upper pipe 24 can then be removed and stacked.

Main drive is then moved in the direction of arrow 20 of FIG. 1 and drive head 14 is coupled to joint section 32 of lower pipe 26. Main drive 12 then pulls lower section 26 and any other pipe sections coupled to pipe 26 beneath ground 18 out in the direction of arrow 22 in FIG. 1. The next joint is then positioned as illustrated in FIG. 2 between backup tong apparatus 36 and power tong apparatus 38. The cycle is then repeated to break the next joint. As illustrated in FIG. 2, backup tong apparatus 36 is spaced apart from power tong apparatus 38 to prevent visual inspection of the joint between the backup tong apparatus 36 and the power tong apparatus 38.

The breakdown tong apparatus 34 can also be used to make up pipe during insertion of the pipe into ground 18 by drilling rig 10. In this instance, backup tongs 36 are actuated in the manner as discussed above to grip a lower section of the pipe when a joint is positioned as illustrated in FIG. 2. Once the rollers 56 of backup tong apparatus 36 are engaged with the lower pipe section, the main drive breaks itself loose from the pipe. The backup tongs 36 continue to hold the pipe joint until another section of pipe can be loaded into drilling rig 10. After the new pipe section is coupled to the partially inserted section, backup tongs 36 release the pipe to permit continued drilling.

FIGS. 9–12 illustrate flow to cylinders 1 and 2 from a hydraulic fluid source 140 using a single control lever 142. Although the preferred embodiment uses a single control lever 142 and a dual sequence control valve 44, it is understood that more than one control lever can be used for controlling flow of hydraulic fluid to cylinders 1 and 2. Preferably, sequence control valve 44 is a model number E81 9JT4 dual sequence control valve body with reverse free flow checks available from Sun Hydraulics located in Sarasota, Fla.

As discussed above, after the joint 28 between upper pipe 24 and lower pipe 26 is located in proper position between backup tong apparatus 36 and power tong apparatus 38, control lever 142 is moved to cause fluid flow into port VA of sequence control valve 44. Initial fluid flow causes pressure to enter port 1A of cylinder 1. Fluid pressure is applied to port 1A up to about 2,000 psi to drive piston 68 to its extended position so that the inner support 60 of backup tong apparatus 36 rotates relative to outer support plates 44 and 46 to cause ramp plates 74 to engage rollers 56 and move rollers 56 into gripping contact with lower pipe section 26. Sequence control valve 44 then supplies fluid pressure to port 2A of cylinder 2 to drive piston 120 of power tong cylinder 2 to its extended position to grip and rotate upper pipe section relative to the lower pipe section 26 which is held in place by backup tong apparatus 36. After joint 28 is broken, pressure is applied to port 2B of sequence control valve 44. This causes initial fluid flow to port 2B of power tong cylinder 2 once the pressure to port 2B reaches about 1200–1500 psi, pressure is supplied to port 1B to retract piston 68 of backup tong cylinder 1. After joint 28 is broken, piston 120 of power tong cylinder 2 can be moved to its retracted position. Control to the main drive 12 is then actuated to continue rotation of drive head 14 about ten revolutions to uncouple upper pipe section 24 from lower pipe section 26 which is still gripped by backup tongs 36. Sequence control valve 44 then actuates cylinder 2 to extend piston 120 and grip upper pipe section 24. Cylinder 120 forces extension arms 112 against stops 138 to firmly grip pipe 24. Main drive 12 then actuates drive head 14 to break the connection between drive head 14 and an upper end of pipe 24. This permits pipe 24 to be removed. Sequence control valve 44 next supplies fluid to port 2B again to move piston 120 to its retracted position illustrated in FIG. 6. Pressure is then supplied to port 1B from sequence control valve 44 to move piston 68 of backup tong cylinder 1 to its fully retracted position to grip the pipe 26. Main drive 12 is then moved in the direction of arrow 20 to couple drive head 14 to pipe 26 while the backup tongs 36 are still engaged with the pipe 26. Pressure is then supplied to port 1A to move piston 68 to its half way position illustrated at location 92 of FIG. 5. Therefore, pipe 26 is free to move relative to backup tongs 36. Main drive 12 then removes the next section of pipe from the ground 18. Once the next joint is aligned with backup tong apparatus 36 and power tong apparatus 38, the breakup procedure is repeated.

Although the invention has been described in detail with reference to a certain preferred embodiment, variations and modifications exist within the scope and spirit of the present invention as described and defined in the following claims.

What is claimed is:

1. A tong apparatus for gripping a pipe, the apparatus comprising:

a base;

a support rigidly coupled to the base, the support being formed to include an aperture for receiving the pipe;

a plurality of rollers rotatably coupled to the support adjacent the aperture, each roller including a plurality of teeth configured to engage the pipe;

a movable actuator coupled to the support;

a plurality of wedge plates rigidly coupled to the actuator, each wedge plate including a plurality of teeth configured to engage the teeth of a corresponding roller to force the rollers radially inwardly against the pipe to grip the pipe upon movement of the actuator relative to the support; and a cylinder having a piston coupled to the actuator, the piston being movable from an extended position to a retracted position to move the actuator relative to the support.

2. The apparatus of claim 1, further comprising an elastic band coupled to the plurality of rollers and to the support to apply a radially outwardly directed force to the rollers to hold the rollers away from the pipe when the wedge plates are disengaged from the rollers.

3. The apparatus of claim 1, wherein the plurality of wedge plates and the plurality of rollers are made from a heat treated metal material.

4. The apparatus of claim 1, wherein the support includes a first support plate coupled to the base, a second support plate rigidly coupled to the base spaced apart from the first support plate, and wherein the teeth of the plurality of rollers are located between the first and second support plates.

5. The apparatus of claim 4, wherein the first and second support plates each include a plurality of elongated slots for receiving opposite ends of the plurality of elongated rollers therein.

6. The apparatus of claim 4, wherein the actuator includes an annular body surrounding the plurality of rollers, the annular body being rotatably coupled between the first and second support plates.

7. The apparatus of claim 6, wherein the wedge plates are configured to engage the rollers upon rotation of the actuator relative to the first and second support plates in either direction.

8. The apparatus of claim 1, wherein the support includes a fixed support rigidly coupled to the base and a rotatable support coupled to the fixed support, the plurality of rollers being coupled to the rotatable support so that the rollers grip and rotate the pipe relative to the fixed support upon movement of the actuator.

9. The apparatus of claim 8, further comprising at least one spring coupled between the actuator and the rotatable support to prevent rotation of the rotatable support until the teeth of the rollers engage the pipe upon movement of the actuator by the piston, the rotatable support rotating relative to the fixed support after the rollers grip the pipe to rotate the pipe upon further movement of the actuator by the piston.

10. The apparatus of claim 9, further comprising an arm coupled to the rotatable support, the arm being coupled to one end of the spring, a first stop coupled to the fixed support to engage the arm and block movement of the rotatable support in a first direction to permit disengagement of the wedge plates from the rollers to release the pipe, and a second stop coupled to the fixed support to engage the arm and block movement of the rotatable support in a second direction to permit a main drive to break itself loose from the pipe.

11. The apparatus of claim 8, wherein the support includes a first fixed support plate coupled to the base, a second fixed support plate rigidly coupled to the base spaced apart from the first support plate, a first rotatable support plate rotatably coupled to the first fixed support plate, and a second rotatable support plate rotatably coupled to the second fixed support plate, and wherein the plurality of rollers are coupled between the first and second rotatable support plates.

12. The apparatus of claim 1, wherein at least three rollers surround the aperture to engage the pipe.

13. The apparatus of claim 1, wherein six rollers are coupled to the support surrounding the aperture and six wedge plates are coupled to the actuator for engaging the six roller.

14. A break down tong apparatus for breaking loose a joint connection between a first pipe and an adjacent second pipe, the apparatus comprising:

a base;

a backup tong including a first support rigidly coupled to the base, the first support being formed to include a first aperture for receiving the first pipe, a first set of rollers rotatably coupled to the first support, each first roller including a plurality of teeth configured to engage the first pipe, a movable first actuator coupled to the first support, a first set of wedge plates rigidly coupled to the first actuator, each wedge plate including a plurality of teeth configured to engage the teeth of a corresponding first roller to force the first rollers radially inwardly against the first pipe to grip the first pipe upon movement of the first actuator relative to the first support, and a first cylinder having a first piston coupled to the actuator, the first piston on being movable from an extended position to a retracted position to move the first actuator relative to the first support;

a power tong including a fixed support rigidly coupled to the base and a rotatable support coupled to the fixed support, the rotatable support being formed to include a second aperture for receiving the second pipe, a second set of rollers rotatably coupled to the rotatable support adjacent the second aperture, each second roller including a plurality of teeth configured to engage the second pipe, a movable second actuator coupled to the fixed support, a second set of wedge plates rigidly coupled to the second actuator, each second wedge plate including a plurality of teeth configured to engage the teeth of a corresponding second roller to force the second rollers radially inwardly against the second pipe to grip the second pipe upon movement of the second actuator relative to the fixed support, and a second cylinder having a second piston coupled to the actuator, the second piston being movable from an extended position to a retracted position to move the actuator relative to the fixed support to rotate the second pipe relative to the first pipe to break the joint connection between the first pipe and the second pipe.

15. The apparatus of claim 14, further comprising a bearing surrounding the first pipe, the bearing being located adjacent the backup tong on an opposite side of the backup tong from the power tong.

16. The apparatus of claim 14, further comprising at least one spring coupled between the second actuator and the rotatable support to prevent rotation of the rotatable support until the teeth of the second rollers engage the second pipe upon movement of the second actuator by the second piston, the rotatable support rotating relative to the fixed support after the second rollers grip the second pipe to rotate the second pipe upon further movement of the second actuator by the second piston.

17. The apparatus of claim 16, further comprising a sequence control valve for actuating, in sequence, the first cylinder to move the first piston to cause the first set of rollers to engage the first pipe, then actuating the second cylinder to move the second piston to cause the second set of rollers to engage the second pipe, and then further moving the second piston to cause rotation of the rotatable support relative to the fixed support to break the joint connection between the first pipe and the second pipe.

18. The apparatus of claim 17, wherein the sequence control valve actuates the second cylinder to move the second piston to release the second set of rollers from the second pipe before the first cylinder is actuated to release the first set of rollers from the first pipe to permit a main drive coupled to the second pipe to rotate the second pipe to uncouple the first pipe from the second pipe.

19. The apparatus of claim 18, wherein the sequence control valve actuates the second cylinder to move the second piston to its extended position after the first and second joint portions are uncoupled to permit the main drive coupled to the second pipe to break itself loose from the end of the second pipe.

20. The apparatus of claim 16, further comprising an arm coupled to the rotatable support, the arm being coupled to one end of the spring, a first stop coupled to the fixed support to engage the arm block movement of the rotatable support in a first direction to permit disengagement of the wedge plates from the rollers to release the pipe, and a second stop coupled to the fixed support to engage the arm and block movement of the rotatable support in a second direction to permit a main drive to break itself loose from the pipe.

21. The apparatus of claim 14, further comprising an first elastic band coupled to the first rollers and to the first support to apply a radially outwardly directed force to the first rollers to hold the first rollers away from the first pipe when the first wedge plates are disengaged from the first rollers, and a second elastic band coupled to the second rollers and to the fixed support to apply a radially outwardly directed force to the second rollers to hold the second rollers away from the second pipe when the second wedge plates are disengaged from the second rollers.

22. The apparatus of claim 14, wherein the first and second plates and the first and second rollers are made from a heat treated metal material.

23. The apparatus of claim 14, wherein the first support includes a first support plate coupled to the base, a second support plate rigidly coupled to the base spaced apart from the first support plate, and wherein the teeth of the plurality of rollers are located between the first and second support plates, and wherein the fixed support includes a first fixed support plate coupled to the base, a second fixed support plate rigidly coupled to the base spaced apart from the first support plate, and the rotatable support includes a first rotatable support plate rotatably coupled to the first fixed support plate, and a second rotatable support plate rotatably coupled to the second fixed support plate, and wherein the second set of rollers is coupled between the first and second rotatable support plates.

24. The apparatus of claim 23, wherein the first actuator includes a first annular body surrounding the first rollers, the first annular body being rotatably coupled between the first and second support plates, and wherein the second actuator includes a second annular body surrounding the second rollers, the second annular body being rotatably coupled between the first and second fixed support plates.

25. The apparatus of claim 14, wherein the first and second sets of rollers each include six rollers and the first and second sets of wedge plates each include six wedge plates.

* * * * *